United States Patent [19]

Cutting et al.

[11] 4,143,300

[45] Mar. 6, 1979

[54] SPIN TUNED MAGNETRONS

[75] Inventors: Alan B. Cutting, Maidenhead; Donald E. Tyzack, Gerrards Cross, both of England

[73] Assignee: E M I-Varian Limited, Hayes, England

[21] Appl. No.: 833,187

[22] Filed: Sep. 14, 1977

[30] Foreign Application Priority Data

Sep. 16, 1976 [GB] United Kingdom ..... 38329/76

[51] Int. Cl.[2] ..... H01J 25/50

[52] U.S. Cl. ..... 315/39.61; 315/39.55

[58] Field of Search ..... 315/39.55, 39.61

[56] References Cited

U.S. PATENT DOCUMENTS

| | | | |
|---|---|---|---|
| 2,714,178 | 7/1955 | Kather | 315/39.61 |
| 2,851,633 | 9/1958 | Dubois | 315/39.61 |
| 3,343,031 | 9/1967 | Backmark | 315/39.61 X |
| 3,365,609 | 1/1968 | Barbasso, Jr. | 315/39.61 X |
| 3,441,796 | 4/1969 | Cooper | 315/39.61 |
| 3,904,919 | 9/1975 | Farney et al. | 315/39.61 |
| 3,914,644 | 10/1975 | Gerard | 315/39.61 |
| 3,932,787 | 1/1976 | Cutting | 315/39.61 |

*Primary Examiner*—Saxfield Chatmon, Jr.
*Attorney, Agent, or Firm*—Fleit & Jacobson

[57] ABSTRACT

In a spin-tuned magnetron a plurality of anode vanes disposed in an annulus form resonant cavities and a spinner, carrying a plurality of apertures rotates coaxially with the annulus to pass through the cavities and vary the resonant frequencies. This expedient gives a frequency variation which is predictable. This invention provides a less predictable frequency variation by modifying the shape of at least one of the vanes and at least one of the apertures. The aperture is in one example modified by cutting a slot between one aperture and the edge of the spinner.

6 Claims, 6 Drawing Figures

SPIN TUNED MAGNETRONS

This invention relates to the tuning of electron discharge devices such as magnetrons.

It is known to provide magnetrons with 'spin' tuning by including a rotatable frequency determining element and means for driving said element using an electric motor, which is external to the device and magnetically coupled to said frequency determining element. Such devices may be used for example within a frequency agile radar system.

Known spin-tuned magnetrons produce a frequency variation which is nearly sinusoidal with a constant amplitude. The frequency of said devices is therefore predictable and consequently susceptible to electronic counter measures (ECM). The invention described hereinafter relates to an improved device which generates a modified frequency variation pattern which is less predictable and thus less susceptible to ECM.

It is an object of the invention to provide a magnetron, including an anode structure comprising: a plurality of vanes, formed of an electrically conductive material; an annular member supporting said vanes substantially parallel to the axis of the annular member and protruding radially therefrom; and a substantially cylindrical sleeve member disposed coaxially with said annular member, so that the vanes and the sleeve member overlap over at least part of their respective axial lengths, and rotatable relative to said vanes, the sleeve member being formed, in said overlapping part, with a plurality of apertures arranged to co-operate with said vanes to determine the frequency to which the magnetron is tuned and to vary said frequency on rotation of the sleeve member, wherein at least one of said vanes differs in shape from the other vanes, and at least one of said apertures differs in shape from the other apertures.

In order that the invention may be clearly understood and readily carried into effect, the same will now be described, by way of example only, in terms of specific embodiments with reference to the accompanying drawing of which:

Figure 1:
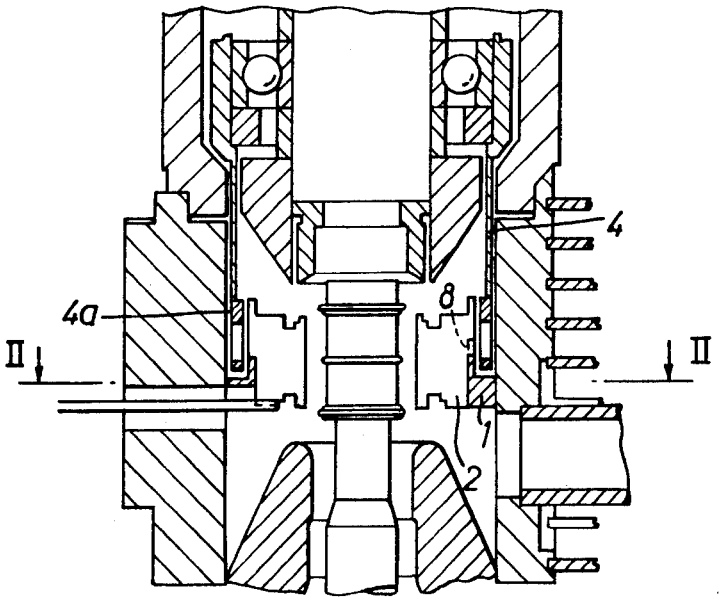
FIG. 1 shows in section a portion of a magnetron
Figure 3:
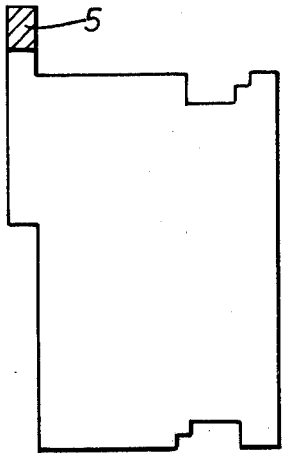
FIG. 3 shows an anode vane, 2, of the magnetron of FIG. 1.
Figure 2:
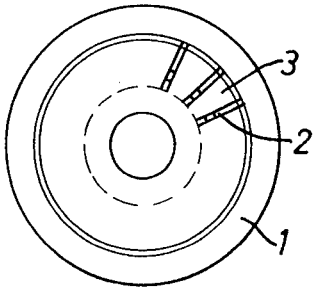
FIG. 2 shows a sectional view along the line II-II in FIG. 1
Figure 4:
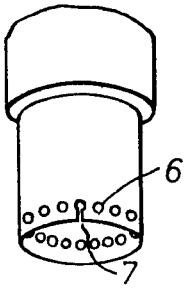
FIG. 4 shows in isometric view the rotatable tuning member 4 of the magnetron of FIG. 1.

FIG. 1 shows part of a magnetron incorporating the invention, including an anode comprising an annulus 1 of electrically conducting material, on which are mounted inwardly directed anode vanes 2 of electrically conductive material. FIG. 2 shows the disposition of said vanes around the annulus at equal intervals, there being typically sixteen of said vanes forming therebetween sixteen resonant cavities such as 3. Also shown in FIG. 1 is a spinner 4, also of electrically conductive material, which is coaxial with the annulus 1 and contains a sleeve portion 4*a* which surrounds the vanes 2 over part at least of their length. FIG. 3 shows one of said anode vanes 2, indicating by cross hatching a portion, 5, which has been removed from one of said vanes but is present in the others. FIG. 4 shows the spinner 4 and an arrangement of apertures 6 around the circumference of the said sleeve portion 4*a* thereof. The number of apertures 6 is in this example equal to the number of resonant cavities between vanes 2. One of the said apertures 6 has a modified shape in that a slot 7 has been formed running from the edge of the aperture to the lower edge of the sleeve 4*a*. The spinner may be mounted and driven in any way suitable for known spin-tuned magnetrons, for example as described in British Pat. No. 999991.

Figure 5:
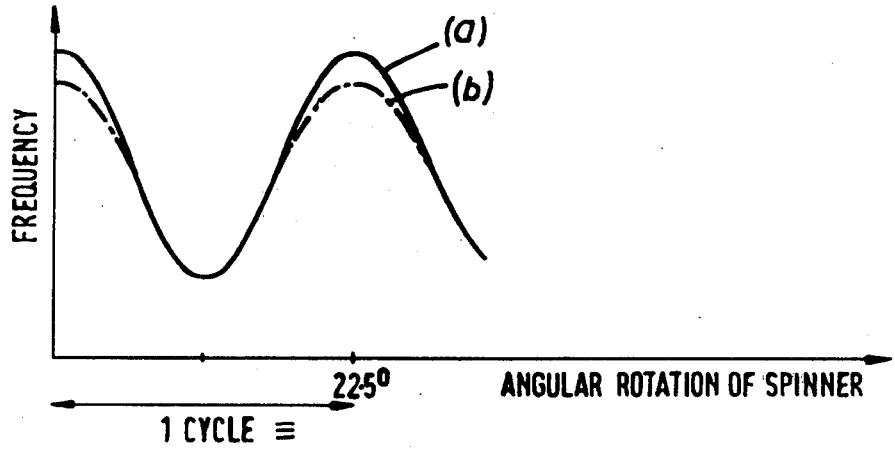
FIGS. 5 and 6 shows some frequency variation patterns.
Figure 6:
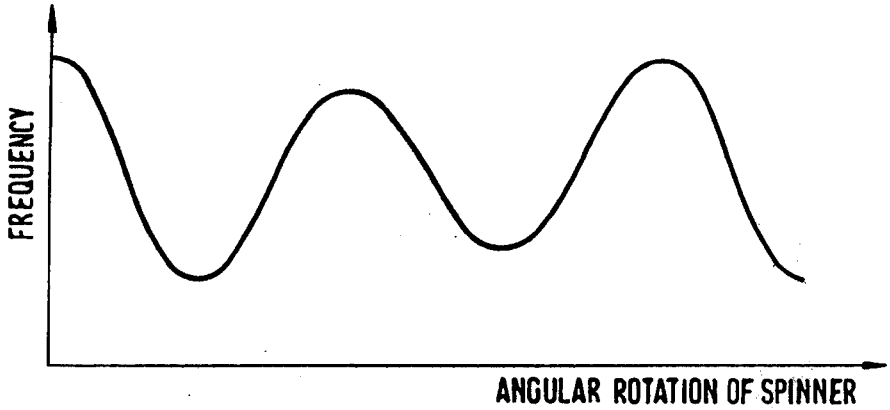

In operation a magnetron, including spinner tuning means, generates a frequency pattern determined by the interaction of the apertures in the spinner with the field pattern at the outer circumference of the anode vane structure. As the resonant frequency of a magnetron is determined by sum effect of all interactions between field pattern and spinner apertures, then if either the spinner or the field pattern have symmetry, the frequency pattern repeats 'N' identical cycles as the spinner rotates through one complete revolution, where 'N' is the number of anode cavities. Thus the frequency variation pattern is nearly sinusoidal and of constant amplitude. This is shown by curve a of FIG. 5 which is a plot of the output frequency of the magnetron against angle of rotation of the spinner from an arbitrary zero. If in the example hereinbefore described only the one slot 7 is added and all the anode vanes are as shown in FIG. 3, i.e. including the portion 5, then the generated frequency pattern repeats sixteen identical cycles, though the maximum frequency decreases by approximately 20MHz from that obtained without the slot, to be as shown by curve b in FIG. 5. This is because in each cycle the slot of the modified spinner interacts with a substantially identical field pattern. If, in addition to a slotted aperture, one anode vane is modified by omission of the portion 5, cross-hatched in FIG. 3, then over one-half cycle (while the slot is behind the modified vane) the minimum frequency of the magnetron is reduced by 24MHz, (as shown by the frequency against angular position plot of FIG. 6) but otherwise the other fifteen and a half cycles are unaltered. The maximum frequency may be further affected if, in combination with a slotted aperture, the height of the annular anode member 1 were to be altered between the vanes as indicated in FIG. 1 by the broken line referenced 8.

The invention is not limited to the above described example. More than one slotted aperture (FIG. 4) and more than one modified anode vane (FIG. 3) may be included in a magnetron. In one such device with three anodes vanes modified and three slotted apertures any of several hundred different patterns may be obtained. Further the invention is not limited to slotted circular apertures as shown in FIG. 4; other shaped apertures may be used.

Whereas previous frequency agile magnetrons have been limited to cyclic frequency patterns of constant amplitude, the improved magnetron according to the invention can generate a frequency variation pattern extremely difficult to predict without long observation times, especially when the observations are taken at the pulse repetition rate of a radar system including such a device.

The magnetron described hereinbefore operates at the 'X' band of frequencies however a scaled version of the invention may operate within other frequency bands.

What we claim is:

1. A magnetron, including an anode structure comprising: an annular member; a plurality of vanes, formed of an electrically conductive material, supported by said annular member to be disposed substantially parallel to the axis of the annular member and protruding radially therefrom; a substantially cylindrical sleeve member disposed coaxially with said annular member, so that the vanes and the sleeve member overlap over at least part of their respective axial lengths, and rotatable about said axis relative to said vanes; and a plurality of apertures formed in the part of the sleeve member which overlaps said vanes to cooperate therewith to determine the frequency to which the magnetron is tuned and to vary said frequency during rotation of the sleeve member, wherein at least one of said vanes differs in shape from the other vanes and at least one of said apertures differs in shape from the other apertures.

2. A magnetron according to claim 1 having at least one slot formed in said sleeve member between said at least one aperture and the edge of the sleeve member.

3. A magnetron according to claim 1 in which said at least one vane is of the same shape as the other vanes with the exception of one region thereof which is omitted.

4. A magnetron according to claim 1 in which the number of vanes of different shape is equal to the number of apertures of different shape.

5. A magnetron according to claim 1 in which the height of the annular member between at least one pair of vanes, is different from the height thereof between other vanes.

6. A magnetron according to claim 5 in which the number of pairs of vanes having a different height region of the annular member therebetween is equal to the number of vanes of different shape.

* * * * *